US007877949B1

(12) United States Patent
Elliott

(10) Patent No.: US 7,877,949 B1
(45) Date of Patent: Feb. 1, 2011

(54) SHINGLE FOR OPTICALLY SIMULATING A SLATE ROOF

(75) Inventor: Bert Whitmore Elliott, Westerville, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 964 days.

(21) Appl. No.: 09/515,928

(22) Filed: Feb. 29, 2000

(51) Int. Cl.
*E04C 1/00* (2006.01)
*E04D 1/00* (2006.01)

(52) U.S. Cl. ..... 52/555; 52/554; 52/559; 52/314

(58) Field of Classification Search ..... 52/518, 52/554, 555, 311.1, 314, 559; D25/139, D25/143; 428/77, 144
See application file for complete search history.

(56) References Cited

U.S. PATENT DOCUMENTS

| | | | | | |
|---|---|---|---|---|---|
| 154,334 | A | * | 8/1874 | Overbury | 432/149 |
| D48,172 | S | * | 11/1915 | Dun Lany | D25/139 |
| 1,495,070 | A | * | 5/1924 | Finley | 52/555 |
| 1,516,243 | A | * | 11/1924 | Perry | 428/208 |
| 1,583,563 | A | * | 5/1926 | Abraham | 52/554 |
| 1,666,429 | A | * | 4/1928 | Stolp, Jr. | 206/323 |
| 1,843,370 | A | * | 2/1932 | Overbury | 427/187 |
| 1,898,989 | A | * | 2/1933 | Harshberger | 52/748.1 |
| 4,195,461 | A | * | 4/1980 | Thiis-Evensen | 52/557 |
| 4,274,243 | A | | 6/1981 | Corbin et al. | |
| 4,717,614 | A | * | 1/1988 | Bondoc et al. | 428/143 |
| D300,257 | S | * | 3/1989 | Stahl | D25/139 |
| 4,869,942 | A | * | 9/1989 | Jennus et al. | 428/77 |
| D309,027 | S | * | 7/1990 | Noone et al. | D25/139 |
| D313,278 | S | * | 12/1990 | Noone | D25/139 |
| 5,181,361 | A | | 1/1993 | Hannah et al. | |
| 5,195,290 | A | * | 3/1993 | Hulett | 52/518 |
| 5,209,802 | A | * | 5/1993 | Hannah et al. | 156/250 |
| D340,294 | S | * | 10/1993 | Hannah et al. | D25/139 |
| D347,900 | S | * | 6/1994 | Stapleton | D25/139 |
| 5,369,929 | A | * | 12/1994 | Weaver et al. | 52/557 |
| 5,375,387 | A | | 12/1994 | Davenport | |
| 5,400,558 | A | | 3/1995 | Hannah et al. | |
| 5,426,902 | A | | 6/1995 | Stahl et al. | |
| D366,124 | S | * | 1/1996 | Hannah et al. | D25/139 |
| 5,488,807 | A | * | 2/1996 | Terrenzio et al. | 52/555 |
| D369,421 | S | * | 4/1996 | Kiik et al. | D25/139 |

(Continued)

*Primary Examiner*—Richard E Chilcot, Jr.
*Assistant Examiner*—Ryan D Kwiecinski
(74) *Attorney, Agent, or Firm*—MacMillan, Sobanski & Todd, LLC

(57) ABSTRACT

A laminated shingle simulates a slate roof when placed with other similar shingles on a roof deck. The laminated shingle includes an overlay member and an underlay member fixedly attached to each other such that the lower edges of the overlay and underlay members are generally co-linear with each other. The overlay member includes an upper or headlap portion and a lower or exposed butt portion with one or more generally rectangular-shaped tabs separated by relatively narrow cutouts. In one embodiment, the width of each tab is randomly selected. Preferably, the entire front surface of the underlay member is coated with a layer of relatively dark granules to enhance the slate simulating aspect of the shingle. In another embodiment, the overlay member also includes a layer of relatively dark granules randomly applied to the upper and lower edges of the tabs. In yet another embodiment, the cutouts of the overlay member and the lower edge of the underlay member includes notches to expose a portion of the underlying overlay member.

15 Claims, 6 Drawing Sheets

U.S. PATENT DOCUMENTS

D375,563 S * 11/1996 Hannah et al. ..... D25/139
D376,660 S * 12/1996 Hannah et al. ..... D25/139
5,611,186 A * 3/1997 Weaver ..... 52/557
D379,672 S * 6/1997 Lamb et al. ..... D25/142
5,660,014 A * 8/1997 Stahl et al. ..... 52/314
5,664,385 A * 9/1997 Koschitzky ..... 52/559
5,666,776 A * 9/1997 Weaver et al. ..... 52/557
5,795,389 A 8/1998 Koschitzky
D400,981 S * 11/1998 Bondoc et al. ..... D25/139
D403,087 S * 12/1998 Sieling et al. ..... D25/139
5,853,858 A 12/1998 Bondoc
D406,361 S * 3/1999 Bondoc et al. ..... D25/143
5,939,169 A * 8/1999 Bondoc et al. ..... 428/141
D417,016 S * 11/1999 Moore et al. ..... D25/139
D417,513 S * 12/1999 Blanpied ..... D25/139
6,014,847 A * 1/2000 Philips ..... 52/311.1
6,105,329 A * 8/2000 Bondac et al. ..... 52/557
6,190,754 B1 * 2/2001 Bondoc et al. ..... 428/143
6,253,512 B1 * 7/2001 Thompson et al. ..... 52/311.1
6,361,851 B1 * 3/2002 Sieling et al. ..... 428/144
6,401,425 B1 * 6/2002 Frame ..... 52/748.1
D466,629 S * 12/2002 Phillips ..... D25/139
6,487,828 B1 * 12/2002 Phillips ..... 52/554
6,523,316 B2 * 2/2003 Stahl et al. ..... 52/557
D473,326 S * 4/2003 Phillips ..... D25/139
6,691,489 B2 * 2/2004 Frame ..... 52/748.1
6,933,037 B2 * 8/2005 McCumber et al. ..... 428/143
2001/0000372 A1 * 4/2001 Kalkanoglu et al. ..... 52/314
2003/0138601 A1 * 7/2003 Elliott ..... 428/143
2004/0055241 A1 * 3/2004 Railkar ..... 52/555
2004/0079042 A1 * 4/2004 Elliott ..... 52/557
2004/0111996 A1 * 6/2004 Heroneme ..... 52/518
2004/0123537 A1 * 7/2004 Elliott et al. ..... 52/314
2004/0123543 A1 * 7/2004 Elliott et al. ..... 52/518
2005/0193673 A1 * 9/2005 Rodrigues et al. ..... 52/518
2005/0210808 A1 * 9/2005 Larson et al. ..... 52/555
2005/0235599 A1 * 10/2005 Kalkanoglu et al. ..... 52/746.11

* cited by examiner

SHINGLE FOR OPTICALLY SIMULATING A SLATE ROOF

TECHNICAL FIELD

This invention relates in general to a shingle, and in particular, to a laminated roofing shingle including an overlay with various cutouts and an underlay such that the shingle operates to optically simulate a slate roof when laid on a roof.

BACKGROUND OF THE INVENTION

In the past, roofing shingles have had to satisfy two main functions when applied to a roof deck. The first function is to provide a durable, weatherproof covering for the roof deck. Roof shingles, whatever their form, are intended to provide a means of sheltering the structure below the shingles from precipitation and the deleterious effects of sun and wind. Roof shingles installed on the roof deck must perform these protecting functions for a reasonable period of time. The second function is to present an aesthetically pleasing architectural feature which enhances the overall appeal of the structure to which the shingles have been applied. This aesthetic function has been satisfied by providing asphalt shingles with various butt edge contours and surface treatments which operate to simulate more traditional, and in most cases more expensive, forms of roof coverings, such as, thatch, wooden shakes, slates, and even tiles of various forms.

Natural slate tiles have long been used as a roof covering. Natural slate is a durable material and is considered to provide an aesthetically pleasing look or appearance to a roof. Natural slate tiles have an advantage as a roof covering in that they will not burn, and therefore they can be used in dry climates where the possibility of fires precludes wood shake roofs. Natural slate tiles are applied to a roof deck or roof framework one tile at a time in a labor intensive process, but the overall appearance of the roof of the individually laid tiles is deemed by the marketplace to be worth a premium price. One of the features of roofs of natural slate is that different sources of slate have different colors. Commonly available colors are gray or green, and different colors such as red are more scarce. Therefore, slate roofs typically have a predominant color, such as gray, with one or more additional accent colors interspersed to add variety. An example of a common mix of colors for a slate roof might include roughly 60 percent of the tiles having a light gray background color, about 15 percent of the tiles having a purple color, and about 25 percent of the tiles having a dark gray color.

As an alternative to the high installed cost of natural slate, roofing suppliers have developed plastic or polymer tiles, such as highly filled thermoset resin tiles. An example of such a polymer tile in the form of wood shake shingles is disclosed in U.S. Pat. Nos. 5,615,523 and 5,711,126, both to Wells et al.

However, none of the prior art shingles have been able to combine the protective and aesthetic functions while providing a laminated, asphalt shingle that simulates a slate roof on a practical production scale.

SUMMARY OF THE INVENTION

This invention relates to a laminated shingle for optically simulating a slate roof when placed with other similar shingles on a roof deck. The laminated shingle comprises an overlay member and an underlay member. The overlay member has a front surface, a rear surface, an upper portion and a lower portion. The lower portion includes one or more tabs separated by cutouts. Each tab includes a layer of granules on the front surface to form a generally uniform color blend. The underlay member has a front surface attached to the rear surface of the overlay member, wherein at least one tab of the shingle has a color blend different from the color of a tab of a different shingle when laid on a roof with other substantially identically shaped shingles in overlapping longitudinal courses.

In another aspect of the invention, a roof covering includes a plurality of successive generally horizontal courses of laminated shingles. The shingles in each course are laid in a side-by-side relationship and horizontally offset from the shingles in adjacent courses. Each laminated shingle comprises an overlay member and an underlay member. The overlay member has front and rear surfaces and includes a headlap portion and a butt portion. The butt portion includes a plurality of tabs separated by cutouts. Each tab includes a layer of granules on the front surface to form a generally uniform color blend. The underlay member has a front surface attached to the rear surface of the overlay member, wherein at least one tab of at least one shingle has a different color blend from the color of at least one other tab when laid on a roof with other substantially identically shaped shingles in overlapping longitudinal courses to optically simulate a slate roof.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
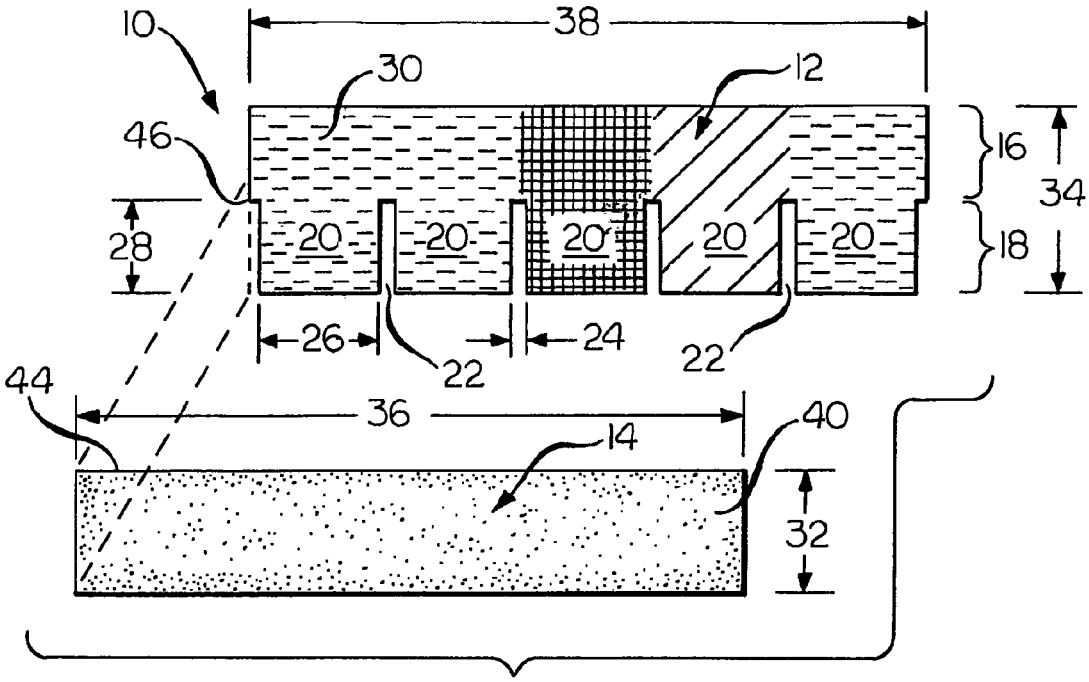
FIG. 1 is an exploded view of a shingle for optically simulating a slate roof according to a first embodiment of the invention.
Figure 2:
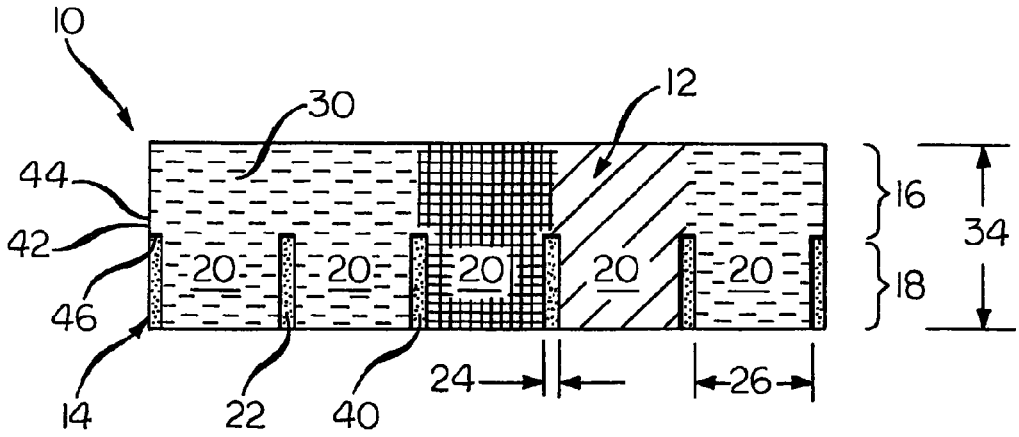
FIG. 2 is a top planar view of the completed shingle of FIG. 1.
Figure 3:
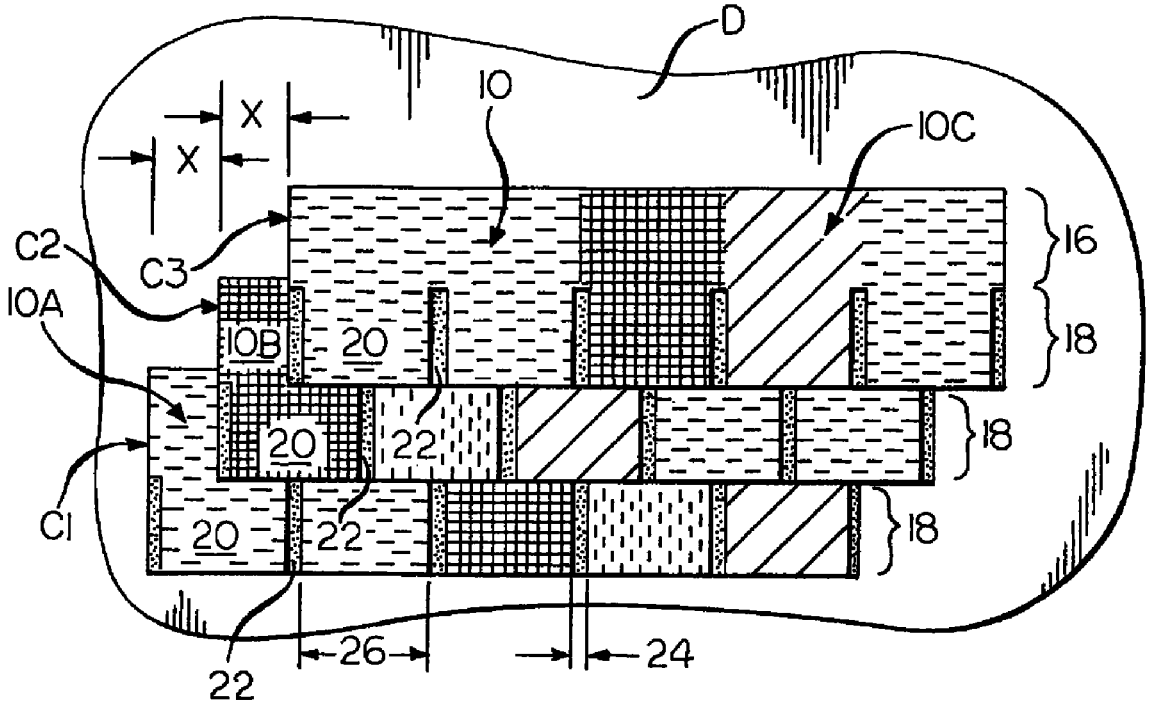
FIG. 3 is a top planar view of a portion of a roof deck covered with the shingles of FIG. 1.

Referring now to the drawings, there is illustrated in FIGS. 1-3 a shingle, shown generally at 10, according to a first embodiment of the invention. The shingle 10 is of a type of roofing shingle generally known as a laminated type shingle consisting of an overlay member 12 and an underlay member 14. The overlay and underlay members 12, 14 are preferably constructed of a suitable mat of fiberglass or other construction that is permeated with a preferably asphaltic substance of a type well-known in the art. Typically, a plurality of granules are dispersed over the front surface and are held by the adhesive characteristics of the asphaltic substance permeating the front surface. It should be appreciated that the invention is not limited by the material composition of the overlay and underlay members 12, 14. For example, the overlay and underlay members 12, 14 may comprise a laminar felted material comprising organic or inorganic fibers, or a mixture of both, that are held together with a binding agent. The fibers may be subsequently coated, saturated, or otherwise impregnated with an asphaltic bituminous material according to processes well known in the roofing industry.

The overlay member 12 includes a headlap or upper portion 16 and an exposed butt or lower portion 18. The lower portion 18 includes one or more tabs 20 which are separated from one another by one or more cutouts 22. The width 24 of the cutouts 22 can be fairly narrow as compared to the width 26 of the tabs 20. For example, the cutouts 22 may have a width 24 of about 1 inch, whereas the tabs 20 may have a width 26 of about 6 inches. It will be appreciated that the relative widths of the tabs 20 and to the cutouts 22 may vary depending on the overall width of the shingle 10. In the first embodiment, the width 26 of each tab 20 and cutout 22 is substantially uniform. Thus, each tab 20 and cutout 22 has generally straight, parallel sides. Preferably, the width 26 and the height 28 of each tab 20 are substantially the same magnitude, thereby forming a generally square-shaped tab 20.

In the first embodiment, the upper portion 16 of the overlay member 12 includes a layer of granules 30 on the front surface. Preferably, the layer of granules 30 is applied to the lower portion 18 with a preciseness such that the color blend for each tab 20 is substantially uniform in color. By definition, the term "color blend" is the overall color effect produced by granules of different colors. An important feature of the invention is that the layer of granules 30 is applied to the shingle 10 with such precision that the boundary between the color blends of two adjacent tabs 20 is substantially horizontally aligned (i.e., along the width 38 of the overlay 12) with the cutout 22 separating the adjacent tabs 20 without the color blends from the adjacent tabs 20 significantly "bleeding" or blending into each other, as best shown in FIGS. 1 and 2. This can be achieved by using a pneumatic granule blender (not shown), as described in co-assigned U.S. Pat. No. 5,746,830, herein incorporated by reference, or by any suitable means. It will be appreciated that adjacent tabs 20 can have different color blends or the same color blend, but each tab 20 will have only one color blend.

Although it is shown that the color blend for a particular tab 20 is applied to the tab 20 and the headlap portion 16 of the overlay member 12, it will be appreciated that less expensive dark or black granules may be applied to the headlap portion 16, rather than the more expensive color granules because the headlap portion 16 will be covered when overlapping successive course of shingles 10 are applied to the roof. In addition, each tab 20 may consist of the same or different color blend that corresponds to a color in a particular pattern unit, as described in co-assigned, co-pending U.S. patent application Ser. No. 09/292,488 filed on Apr. 14, 1999, herein incorporated by reference. Applying shingles to the roof using a particular pattern provides for an attractive, aesthetically pleasing roof appearance. One specific configuration incorporated by reference from patent application Ser. No. 09/292,488 (now issued as U.S. Pat. No. 6,253,512) includes the configuration of FIG. 1 of the patent application, which shows that the predominant tab color of the overall roof covering occurs in 55.6 percent of the tabs. Another specific configuration incorporated by reference is that shown in FIG. 2, which shows that the predominant tab color occurs in 55.6 percent of the tabs. Yet another specific configuration incorporated by reference is that shown in FIG. 3, which shows that the predominant tab color occurs in 58.3 percent of the tabs. Another specific configuration incorporated by reference is that shown in FIG. 4, which shows a predominant tab color occurring in 55.6 percent of the tabs. An additional specific configuration incorporated by reference is that shown in FIG. 6, which shows that the predominant tab color occurs in 56.4 percent of the tabs.

In the first embodiment, the underlay member 14 has a height 32 of approximately one-half of the height, 34, of the overlay member 12. The width 36 of the underlay member 14 is approximately equal to the width 38 of the overlay member 16. In the first embodiment, the underlay member 14 is generally rectangular in shape.

In a manner similar to the overlay member 12, the underlay member 14 includes a layer of granules 40 on the front surface. Preferably, the layer of granules 40 causes the front surface to appear dark or black in appearance. In the first embodiment, the layer of granules 40 completely covers the entire front surface of the underlay member 14.

To form the laminated shingle 10 of the invention, the rear surface of the overlay member 12 and the front surface of the underlay member 14 are fixedly attached to each other. This can be accomplished by using adhesive materials applied to the front surface of the underlay member 14 and the rear surface of the overlay member 12 in a variety of different ways. For example, an adhesive may be applied between each tab 20 of the overlay member 12 and the corresponding underlying portion of the underlay member 14. Additionally, it may be desirable to provide a common bonding area 42 defined by the area of overlap between an upper edge 44 of the underlay member 14 and a lower boundary 46 of the headlap portion 16. Preferably, the common bonding area 42 extends substantially the entire width 38 of the shingle 10 above the upper edge of each of the cutouts 22 and proximate to the lower boundary 46 of the overlay member 16. The width of the common bonding area 42 depends on the height 28 of the tabs 20 and cutouts 22 with respect to the height 32 of the underlay member 14. In addition, the width of the common bonding area 42 to depends on the height 34 of the completed shingle 10. Preferably, the common bonding area 42 has a width in the range of about 1 to 2 inches, and more preferably about 1.5 inches (3.8 cm).

As best seen in FIG. 2, the completed shingle 10 is of a generally rectangular shape having a width 38 of approximately 40 inches (101.6 cm) and an overall height 34 of approximately 17.0 inches (43.2 cm). The overall height 34 is divided between the upper or headlap portion 16 having a dimension of approximately 9.5 inches (24.1 cm) and the lower or exposed butt portion 18 having a dimension of approximately 7.5 inches (19.1 cm) when arranged with other similar shingles on a roof deck as described below. In the completed shingle 10, a lower edge of the overlay member 12 is generally co-linear with a lower edge of the underlay member 14. It should be appreciated that the invention is not limited by the dimensions of the shingle 10, and that the invention can be practiced with any dimensions. For example, the width 38 may be approximately 36 inches (91.4 cm) and the height 34 may be approximately 24.0 inches (61.0 cm).

Although the shingle 10 shown has five tabs 20, it is to be understood that the shingle 10 can have any number of tabs 20.

Referring now to FIG. 3, there is illustrated a fragmentary roof deck, D, with a roof covering made with a plurality of roofing shingles 10 according to the first embodiment of the invention. In general, the roofing shingles 10 are arranged in a series of horizontal courses of which a portion of three such courses C1, C2 and C3 are shown. Shingle 10A in course C1 is shown being overlapped by shingle 10B in course C2. Likewise, shingle 10B in course C2 is shown being overlapped by shingle 10C in course C3. The extreme left-most and right-most edges of shingles 10A, 10B, 10C are shown without the shingles which would normally precede and succeed these shingles in each of the courses, C1, C2, C3. This is done in order to more fully illustrate the desired placement of each shingle in each overlapping course. Thus, it is understood that the roof deck, D, in the finished tile simulating roof covering would be substantially completely covered by a plurality of substantially identically shaped shingles 10A, 10B, and 10C.

One feature of the invention is the desirable sequence in which the shingles making up each overlapping course are laid. Preferably, the shingles 10A making up course C1 would be laid for a substantial horizontal distance along deck, D. Then, shingles 10B making up course C2 are laid in an overlapping fashion such that the headlap portion 16 of the shingles 10A making up course C1 are covered by shingles 10B in course C2. Also, it should be noted that the identically shaped shingles in overlapping longitudinal courses (for example, C2 and C3) are longitudinally or horizontally offset by a predetermined distance, X. This longitudinal offset serves to prevent the joint which is formed between each adjacent shingle in each course from corresponding to the joint between the shingles in the subsequent overlapping course. If this were not done, water from precipitation would inevitably penetrate these joints and potentially damage the underlying roof deck, D. In offsetting these joints, there is no direct path for such water between each shingle.

In addition to preventing the penetration of water from precipitation, offsetting the shingles in subsequent overlapping courses provides an overall aesthetic effect. In the first embodiment, the distance, X, is equal to approximately ½ of the width 26 of the tab 20 of each shingle 10A, 10B, and 10C. The choice of this distance, X, horizontally offsets each tab 20 of the shingles 10A, 10B, and 10C in longitudinal course, C1, with the overlapping longitudinal course, C2. Similarly, each tab 20 of the shingles 10A, 10B, and 10C of the longitudinal course, C2, is horizontally offset from each corresponding tab 20 of the overlapping longitudinal course, C3. Because the distance, X, is equal to approximately ½ of the width 26 of the tab 20, the corresponding tabs 20 of each alternating course, for example, courses C1 and C3, are vertically aligned with each other.

As mentioned earlier, the shingles 10A, 10B, and 10C making up the courses C1, C2 and C3 are laid on the roof deck, D. Preferably, the color blends for each tab 20 correspond to a color in a particular pattern unit, as described in co-pending U.S. patent application Ser. No. 09/292,488, mentioned above. In this manner, the shingles achieve an aesthetically pleasing overall appearance and optically simulate a natural slate roof. Other color patterns can be used as well. In addition, the cutouts 22 of the overlay member 12 expose a portion of the dark or black front surface of the underlay member 14 optically simulating a three-dimensional effect for each tab 20.

Figure 4:
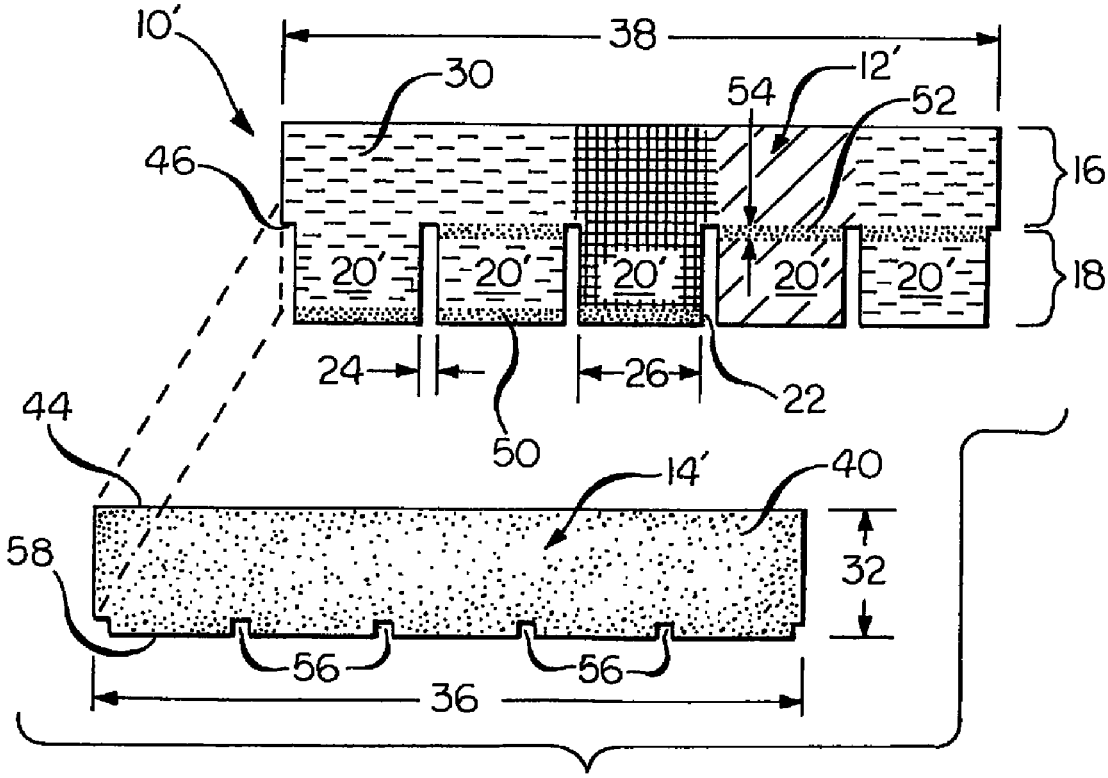
FIG. 4 is an exploded view of a shingle for optically simulating a slate roof according to a second embodiment of the invention.
Figure 5:
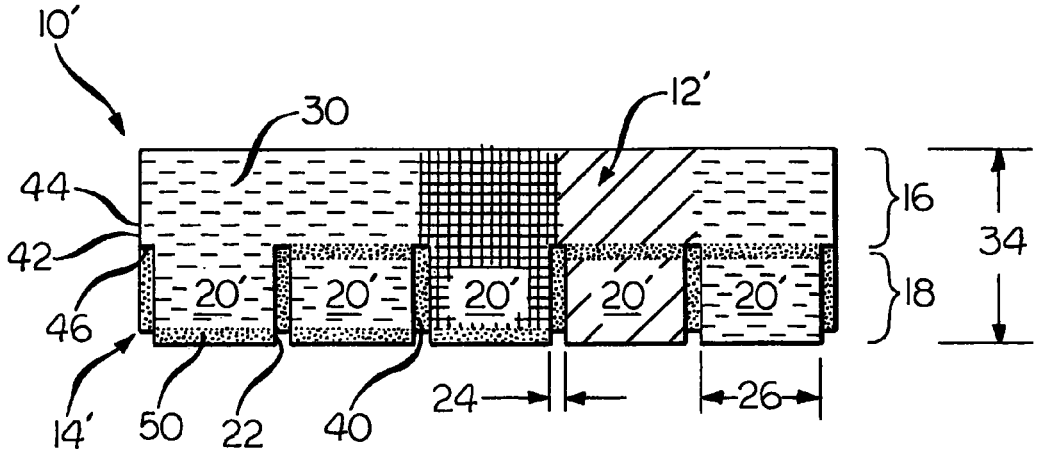
FIG. 5 is a top planar view of the completed shingle of FIG. 4.
Figure 6:
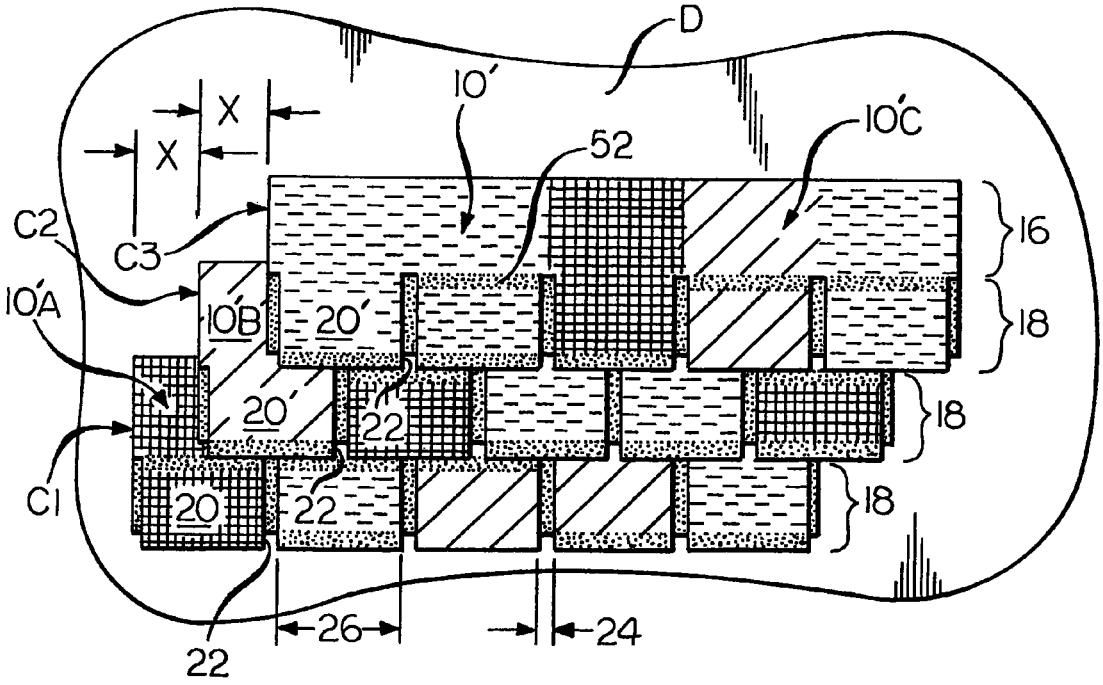
FIG. 6 is a top planar view of a portion of a roof deck covered with the shingles of FIG. 4.

FIGS. 4-6 illustrate a shingle 10' according to a second embodiment of the invention. In the second embodiment, the overlay member 12' is identical to the overlay member 12 of the first embodiment, except that each tab 20' includes an additional layer of granules 50 on the front surface that forms a darker shading area 52 adjacent the headlap portion 16 of the overlay member 12'. The layer of granules 50 forming the darker shading area 52 can be applied intermittently in a random fashion from one tab 20' to another. For example, the layer of granules 50 may be applied along the bottom edge of the leftmost tab 20' while the layer of granules 50 is applied along the bottom and top edges of the adjacent tab 20'. It will be appreciated that the invention can be practiced by varying the location of the layer of granules 50 in many different random locations on the tabs 20' to produce the desired optical effect. When applied to the top edge of the tab 20', the layer of granules 50 can provide the roofer a guide in applying the shingles 12' in a straight line, one next to the other, and in applying successive, overlapping courses. The height or thickness 54 of the darker shading area 52 is preferably in the range between about 0.5 inches to 2.0 inches, and more preferably about 1.0 inches. However, it should be appreciated that the height 54 of the darker shading area 52 can be varied depending on the dimensions of the shingle 10' and the desired optical effect when similar shingles are laid on the roof deck.

The shingle 10' according to the second embodiment also differs from the shingle 10 of the first embodiment in that the underlay member 14' includes one or more notches 56. The notches 56 are preferably formed at the lower edge 58 of the underlay member 14'. Preferably, the notches 56 are in horizontal alignment with the cutouts 22 of the overlay member 12'. In this manner, the cutouts 22 expose a portion of the overlay member 12' of the preceding course when laid on the roof. As shown in FIG. 6, a different optical effect than that of the shingle 10 of the first embodiment is achieved by exposing a portion of the overlay member 12' of the preceding course when laid on a roof deck, D.

Figure 7:
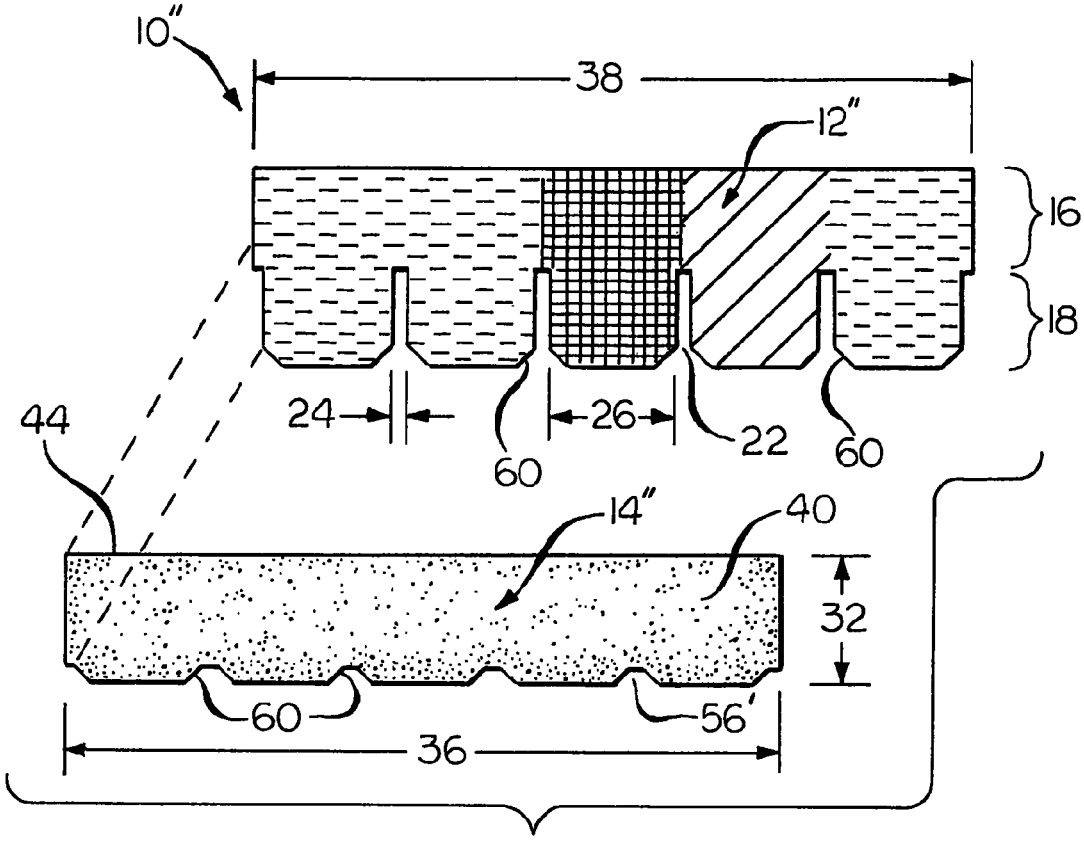
FIG. 7 is an exploded view of a shingle for optically simulating a slate roof according to a third embodiment of the invention.
Figure 8:
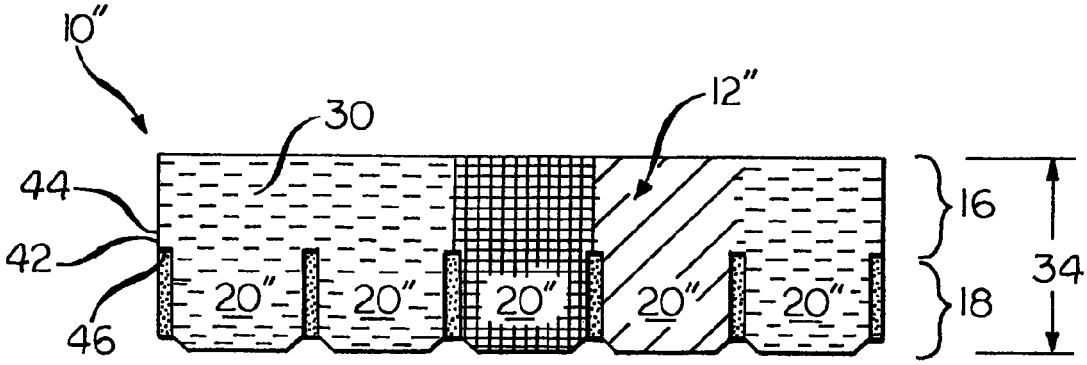
FIG. 8 is a top planar view of the completed shingle of FIG. 7.
Figure 9:
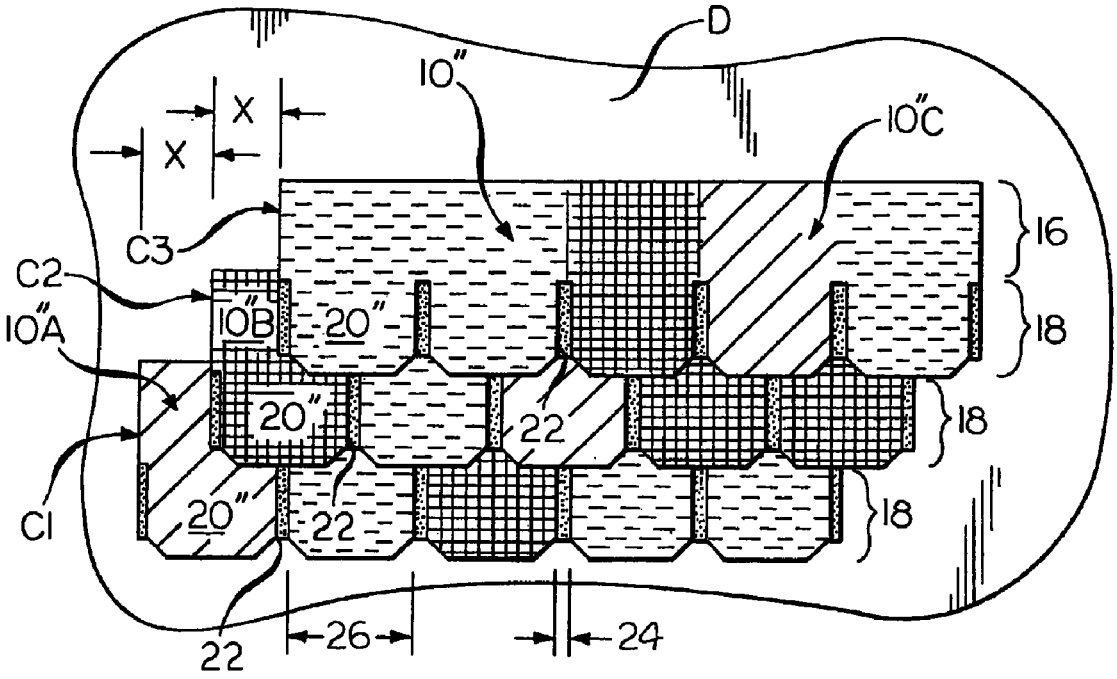
FIG. 9 is a top planar view of a portion of a roof deck covered with the shingles of FIG. 7.

FIGS. 7-9 illustrate a shingle 10" according to a third embodiment of the invention. In the third embodiment, the overlay member 12" is identical to the overlay member 12 of the first embodiment, except that the cutouts 22 include beveled edges 60. Similarly, the underlay member 14" also includes notches 56' with beveled edges 60 that correspond generally in shape to the beveled edges 60 of the overlay member 12". Preferably, the notches 56' and beveled edges 60 of the underlay member 14" are in horizontal alignment with the cutouts 22 and beveled edges 60 of the overlay member 12'. In this manner, the cutouts 22 expose a portion of the overlay member 12" of the preceding course when laid on the roof. As shown in FIG. 9, a different optical effect than that of the shingles 10 and 10' of the first and second embodiments is achieved by exposing a portion of the overlay member 12" of the preceding course when laid on the roof deck, D. It will be appreciated that the tabs 20" of the shingle 10" of the third embodiment may also include the layer of granules 50 to form the darker shading area 52 on the front surface of the overlay member 12".

Figure 10:
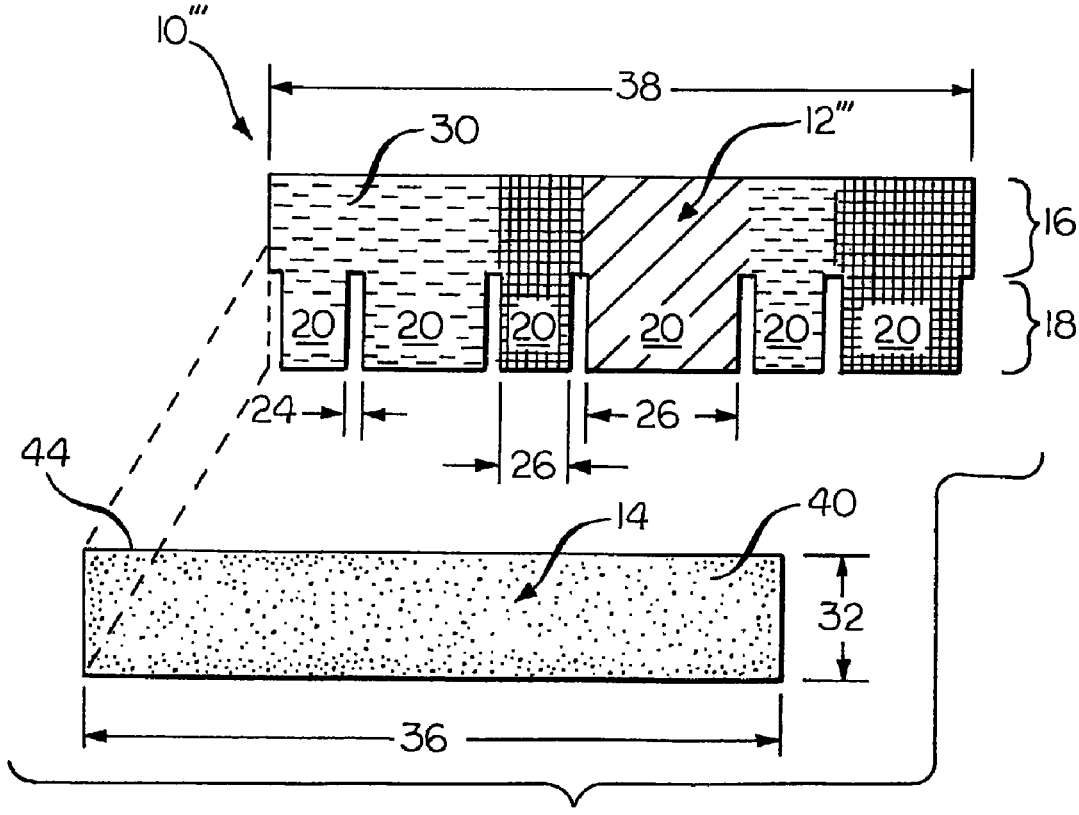
FIG. 10 is an exploded view of a shingle for optically simulating a slate roof according to a fourth embodiment of the invention.
Figure 11:
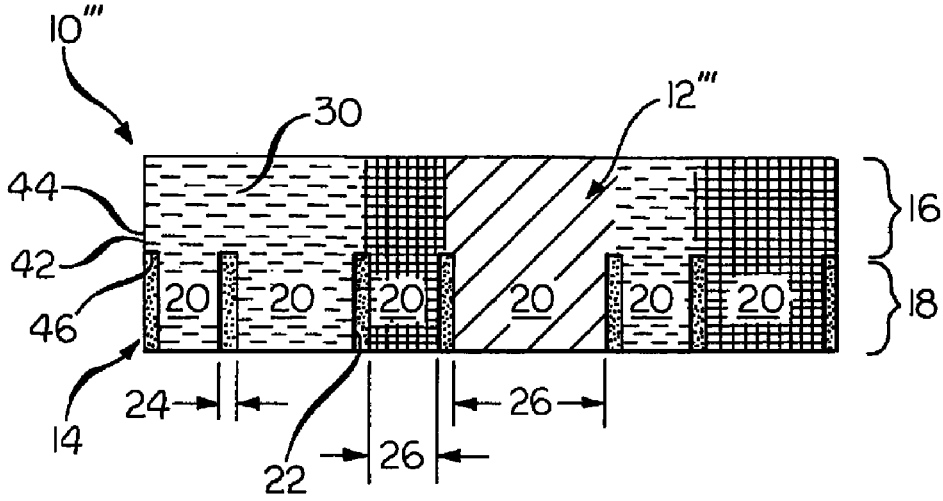
FIG. 11 is a top planar view of the completed shingle of FIG. 10.
Figure 12:
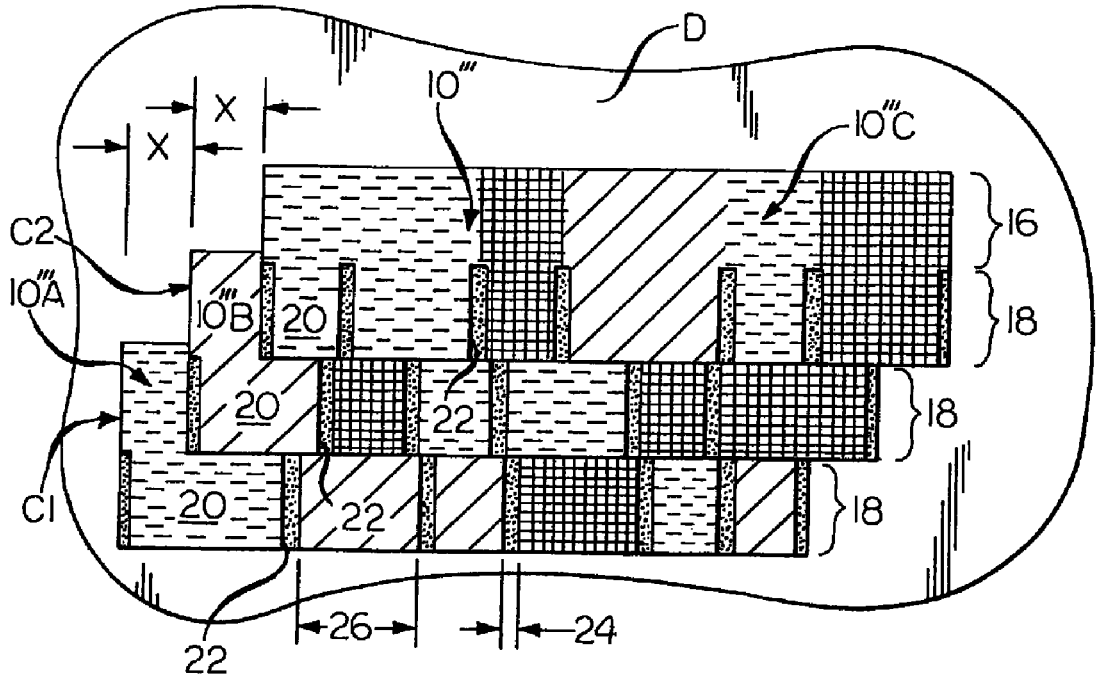
FIG. 12 is a top planar view of a portion of a roof deck covered with the shingles of FIG. 10.

FIGS. 10-12 illustrate a shingle 10'" according to a fourth embodiment of the invention. In the fourth embodiment, the overlay member 12'" is identical to the overlay member 12 of the first embodiment, except that the width 26 of each tab 20 is randomly sized with respect to each other. As best shown in FIG. 12, a different optical effect than that of the shingles 10, 10', 10" of the earlier embodiments is achieved by the randomly-sized tabs 20. It will be appreciated that the tabs 20 of the shingle 10'" of the fourth embodiment may also include the layer of granules 50 to form the darker shading area 52 of the overlay member 12'''. In addition, the underlay member 14 of the fourth embodiment may include the notches 56 with or without the beveled edges 60, and the overlay member 12''' may also include the corresponding beveled edges 60, as described in the second and third embodiments.

In a specific embodiment of the invention, approximately 60% of the plurality of tabs have a first background color comprising a light gray, approximately 25% of the plurality of tabs have a second background color, comprising dark gray, and about 15 percent of the tiles have a third color other than gray. Preferably, the third color comprises purple.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A roof covering including a plurality of successive generally horizontal courses of laminated shingles, the shingles in each course being laid in a side-by-side relationship and horizontally offset from the shingles in adjacent courses, each laminated shingle comprising:

an overlay member having front and rear surfaces, the overlay member including a headlap portion and a butt portion, the butt portion including a plurality of tabs separated by cutouts, each tab including a layer of granules on the front surface forming a generally uniform color blend, and each cutout being narrow when compared to the width of the tabs to provide an overall roof covering appearance of a natural slate roof; and an underlay member having a front surface attached to the rear surface of the overlay member;

wherein each tab has a single color blend, the color blends of some of the tabs of each shingle being a color blend different from the color blend of others of the tabs; and wherein one of the color blends of the tabs occurs more frequently than any of the other color blends of the tabs, thereby defining a predominant tab color blend, with the frequency of the tabs of the predominant color blend in the roof covering being sufficiently prevalent to provide the roof covering with an appearance that simulates a natural slate roof.

2. The roof covering according to claim 1, wherein the predominant tab color blend occurs in roughly 60 percent of the tabs.

3. The roof covering according to claim 2, wherein each laminated shingle has at least four tabs.

4. The roof covering according to claim 2, wherein each laminated shingle is a three-tab laminated shingle.

5. The roof covering according to claim 1, wherein each laminated shingle has at least four tabs.

6. The roof covering according to claim 1, wherein each laminated shingle is a three-tab laminated shingle.

7. The roof covering according to claim 1, wherein the cutouts have, a width of about 1 inch and the tabs have a width of about 6 inches.

8. A roof covering including a plurality of successive generally horizontal courses of laminated shingles, the shingles in each course being laid in a side-by-side relationship and horizontally offset from the shingles in adjacent courses, each laminated shingle comprising:

an overlay member having front and rear surfaces, the overlay member including a headlap portion and a butt portion, the butt portion including a plurality of tabs separated by cutouts, each tab including a layer of granules on the front surface forming a generally uniform color blend, and each cutout being narrow when compared to the width of the tabs to provide an overall roof covering appearance of a natural slate roof; and an underlay member having a front surface attached to the rear surface of the overlay member;

wherein each tab has a single color blend, the color blends of some of the tabs of each shingle being a color blend different from the color blend of others of the tabs; and wherein one of the color blends of the tabs is gray, the gray color blend occurring more frequently than any of the other color blends of the tabs, thereby defining a predominant tab color blend, with the frequency of tabs of the gray color blend in the roof covering being sufficiently prevalent to provide the roof covering with an appearance that simulates a natural slate roof.

9. The roof covering according to claim 8, wherein the predominant tab color blend occurs in roughly 60 percent of the tabs.

10. The roof covering according to claim 9, wherein each laminated shingle has at least four tabs.

11. The roof covering according to claim 9, wherein each laminated shingle is a three-tab laminated shingle.

12. The roof covering according to claim 8, wherein the cutouts have a width of about 1 inch and the tabs have a width of about 6 inches.

13. A roof covering including a plurality of successive generally horizontal courses of laminated shingles, the shingles in each course being laid in a side-by-side relationship and horizontally offset from the shingles in adjacent courses, each laminated shingle comprising:

an overlay member having front and rear surfaces, the overlay member including a headlap portion and a butt portion, the butt portion including a plurality of tabs separated by cutouts, each tab including a layer of granules on the front surface forming a generally uniform color blend; and an underlay member having a front surface attached to the rear surface of the overlay member;

wherein each tab has a single color blend, the color blends of some of the tabs of each shingle being a color blend different from the color blend of others of the tabs; and wherein one of the color blends of the tabs occurs more frequently than any of the other color blends of the tabs, thereby defining a predominant tab color blend, with the other color blends being accent colors that occur less frequently in the roof covering, with the frequency of tabs of the predominant color blend in the roof covering being sufficiently prevalent to provide a roof covering with an appearance that simulates a natural slate roof.

14. The roof covering according to claim 13, wherein the predominant tab color blend occurs in roughly 60 percent of the tabs.

15. The roof covering according to claim 13, wherein the cutouts have a width of about 1 inch and the tabs have a width of about 6 inches.

* * * * *